US006022296A

United States Patent [19]

Yu

[11] Patent Number: 6,022,296

[45] Date of Patent: Feb. 8, 2000

[54] STEPPING EXERCISER

[76] Inventor: Hui-Nan Yu, 5F-23, 70, Fu-Shing Rd., Taoyuan, Taiwan

[21] Appl. No.: 09/358,018

[22] Filed: Jul. 21, 1999

[51] Int. Cl.[7] ..... A63B 69/16; A63B 22/04

[52] U.S. Cl. ..... 482/52; 482/51

[58] Field of Search ..... 482/51, 52, 53, 482/57, 63, 70, 71, 79, 80

[56] References Cited

U.S. PATENT DOCUMENTS

| | | | |
|---|---|---|---|
| 5,577,985 | 11/1996 | Miller | 482/51 |
| 5,733,227 | 3/1998 | Lee | 482/52 |
| 5,769,760 | 6/1998 | Lin et al. | 482/51 |
| 5,788,610 | 8/1998 | Eschenbach | 482/70 |
| 5,846,166 | 12/1998 | Kuo | 482/52 |
| 5,868,650 | 2/1999 | Wu | 482/62 |
| 5,897,463 | 4/1999 | Maresh | 482/51 |

*Primary Examiner*—Stephen R. Crow
*Attorney, Agent, or Firm*—Dougherty & Troxell

[57] ABSTRACT

A stepping exerciser, which includes a base frame having an upright support and two horizontal pivots at two opposite sides of the upright support, a damping mechanism mounted on the upright support at the top, the damping mechanism having two cranks disposed at two opposite sides and rotated to impart a damping force, two pedals respectively turned about the horizontal pivots at the upright support, the pedals each having a front end provided with a pivot hole and a rear end provided with a foot plate, and two handlebars respectively fixedly connected to the cranks, the handlebars each having a top end terminating in a hand grip and a bottom end terminating in a horizontal pivot respectively coupled to the pivot at the front end of each of the pedals.

1 Claim, 3 Drawing Sheets

STEPPING EXERCISER

BACKGROUND OF THE INVENTION

The present invention relates to a stepping exerciser, and more particularly to such a stepping exerciser, which comprises two handlebars coupled between a damping mechanism and two pedals, and alternatively turned back and forth upon alternative motion of the pedals.

SUMMARY OF THE INVENTION

It is one object of the present invention to provide a stepping exerciser, which has a simple structure and, is inexpensive to manufacture. It is another object of the present invention to provide a stepping exerciser, which enables the player to exercise the hands when stepping the pedals. According to the present invention, the stepping exerciser comprises a base frame, two pedals pivoted to the base frame at two opposite sides, a damping mechanism mounted on the base frame at a top side, and two handlebars coupled between the damping mechanism and the pedals. When stepping on the pedals, the handlebars are turned back and forth, and at the same time the damping mechanism is turned to impart a damping force to the handlebars and the pedals.

DETAILED DESCRIPTION OF THE PREFERRED EMBODIMENT

Figure 1:
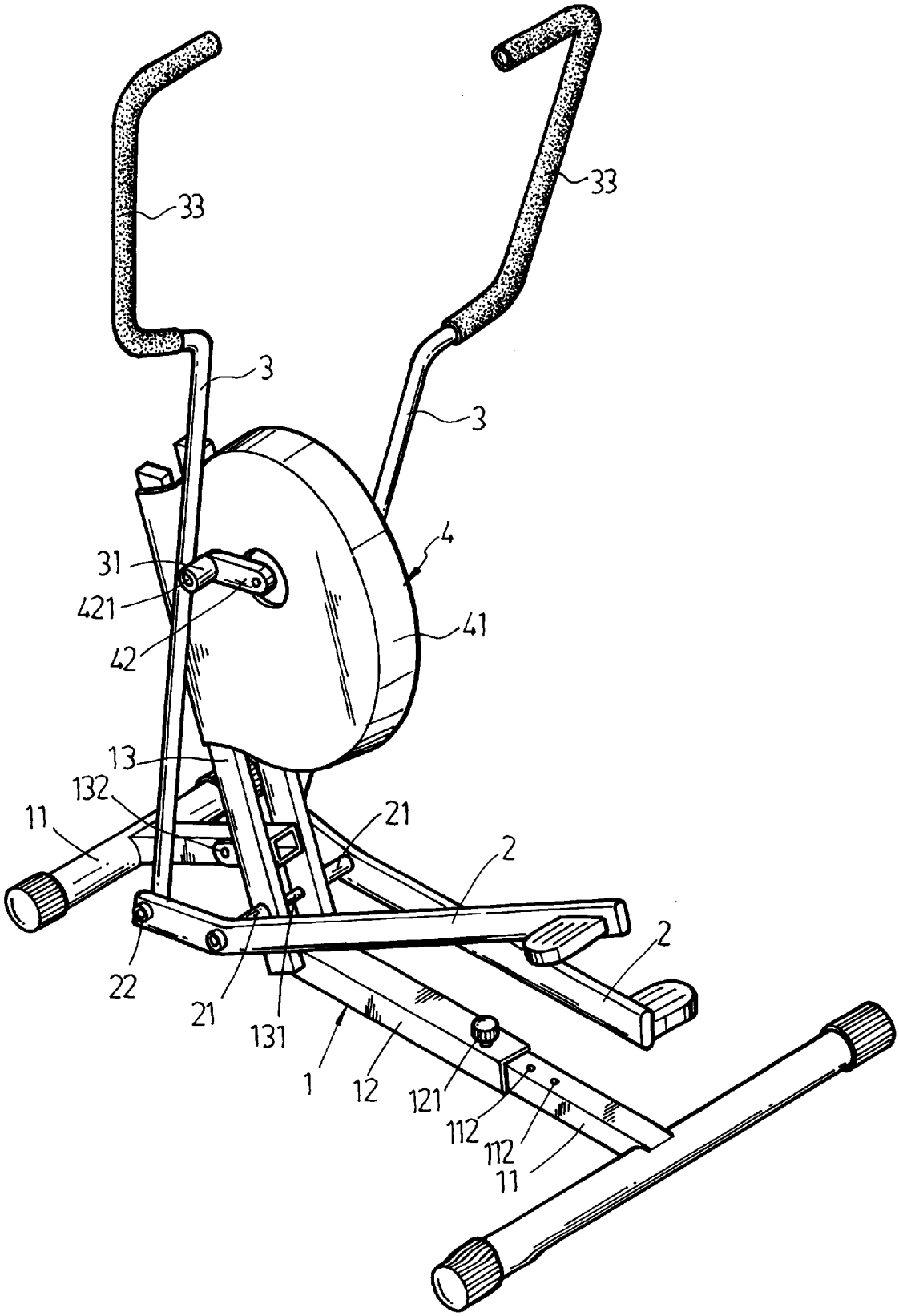
FIG. 1 is a perspective view of a stepping exerciser according to the present invention.
Figure 2:
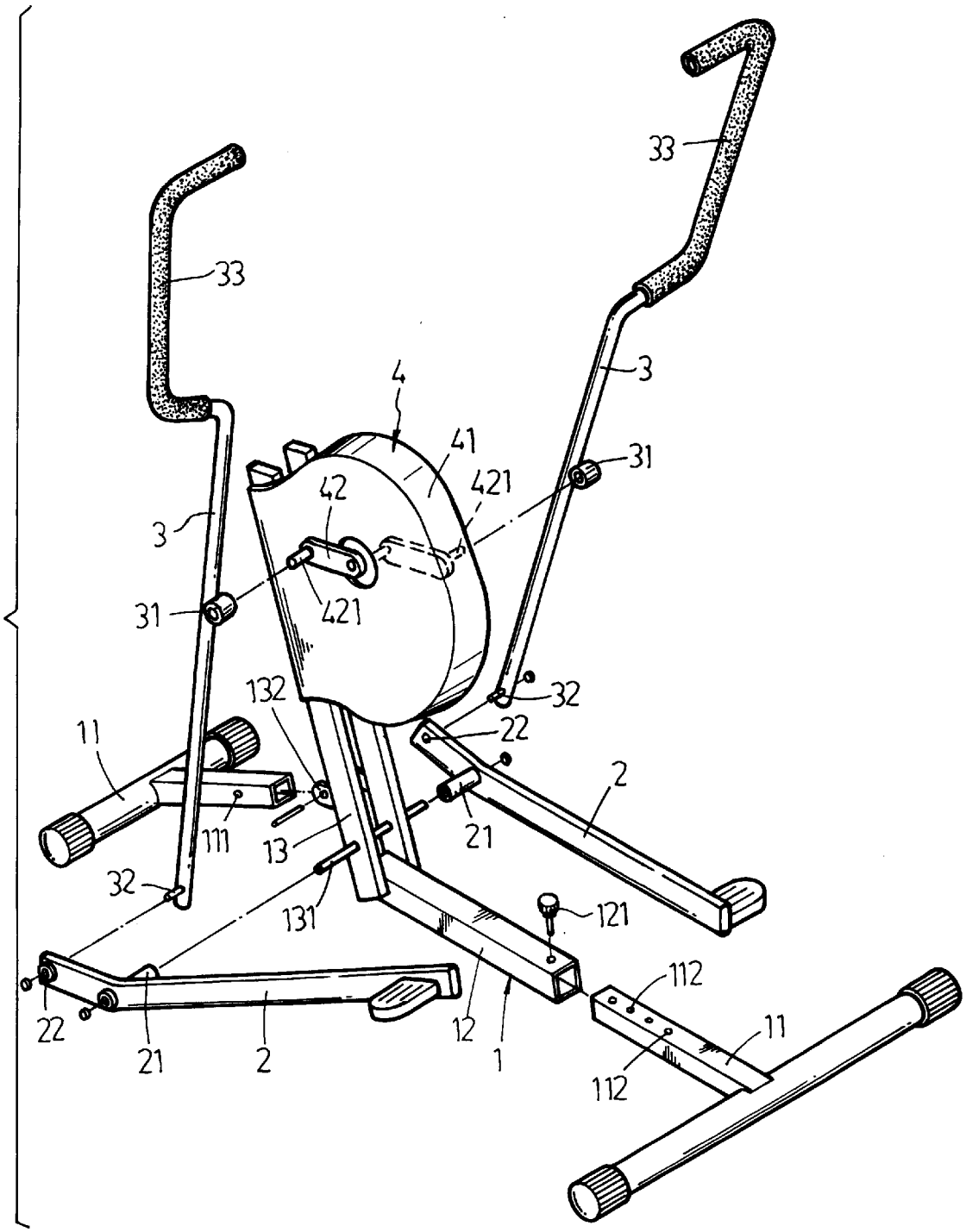
FIG. 2 is an exploded view of the stepping exerciser shown in FIG. 1.

Referring to FIGS. 1 and 2, a stepping exerciser in accordance with the present invention is shown comprised of a base frame 1, two pedals 2, two handlebars 3, and a damping mechanism 4. The damping mechanism 4 comprises an ornamental outer shell 41 holding on the inside a drive chain wheel, a driven chain wheel, a chain, a flywheel, and a bearing block. Two linked cranks 42 are coupled to the bearing block of the damping mechanism 4, and extended out of the ornamental outer shell 41 at two opposite sides. Each crank 42 has a cylindrical outer end 421. Rotating the cranks 42 causes the drive chain wheel to rotate the driven chain wheel through the chain, thereby causing the flywheel to be synchronously rotated, and a force of damping mechanism is given to the player. Because the structure of the damping mechanism 4 is of the known art, detailed description is not necessary.

The base frame 1 comprises a front end bar 11, a rear end bar 11', a middle connecting bar 1, and an upright support 13. The rear end bar 11' comprises a longitudinal series of adjustment holes 112 selectively connected to one end, namely, the rear end of the middle connecting bar 1 by an adjustment screw 121. The upright support 13 is fixedly and obliquely connected to one end, namely, the front end of the middle connecting bar 12 remote from the rear end bar 11'. The upright support 13 comprises two horizontal pivots 131 at two opposite lateral sides thereof at above the elevation of the middle connecting bar 12, and a pair of forward lugs 132 raised from the front side wall thereof above the elevation of the horizontal pivots 131. The front end bar 11 comprises a mounting hole 111 connected between the forward lugs 132 at the upright support 13 by screw means. The damping mechanism 4 is fixedly mounted on the upright support 13 near the top. The pedals 2 are coupled to the upright support 13 and the handlebars 3 at two opposite lateral sides, each having a pivot hole 22 at the front end, a foot plate 23 at the rear end, and a fixed axle sleeve 21 transversely disposed between the pivot hole 22 and the foot plate 23 and respectively coupled to the horizontal pivots 131 at the upright support 13. The handlebars 3 each comprise a hand grip 33 at the top, a pivot 32 at the bottom coupled to the pivot hole 22 at the front end of one pedal 2, and a barrel 31 transversely disposed between the pivot 32 and the hand grip 33 and fixedly connected to the cylindrical outer end 421 of one crank 42 of the damping mechanism 4.

Figure 3:
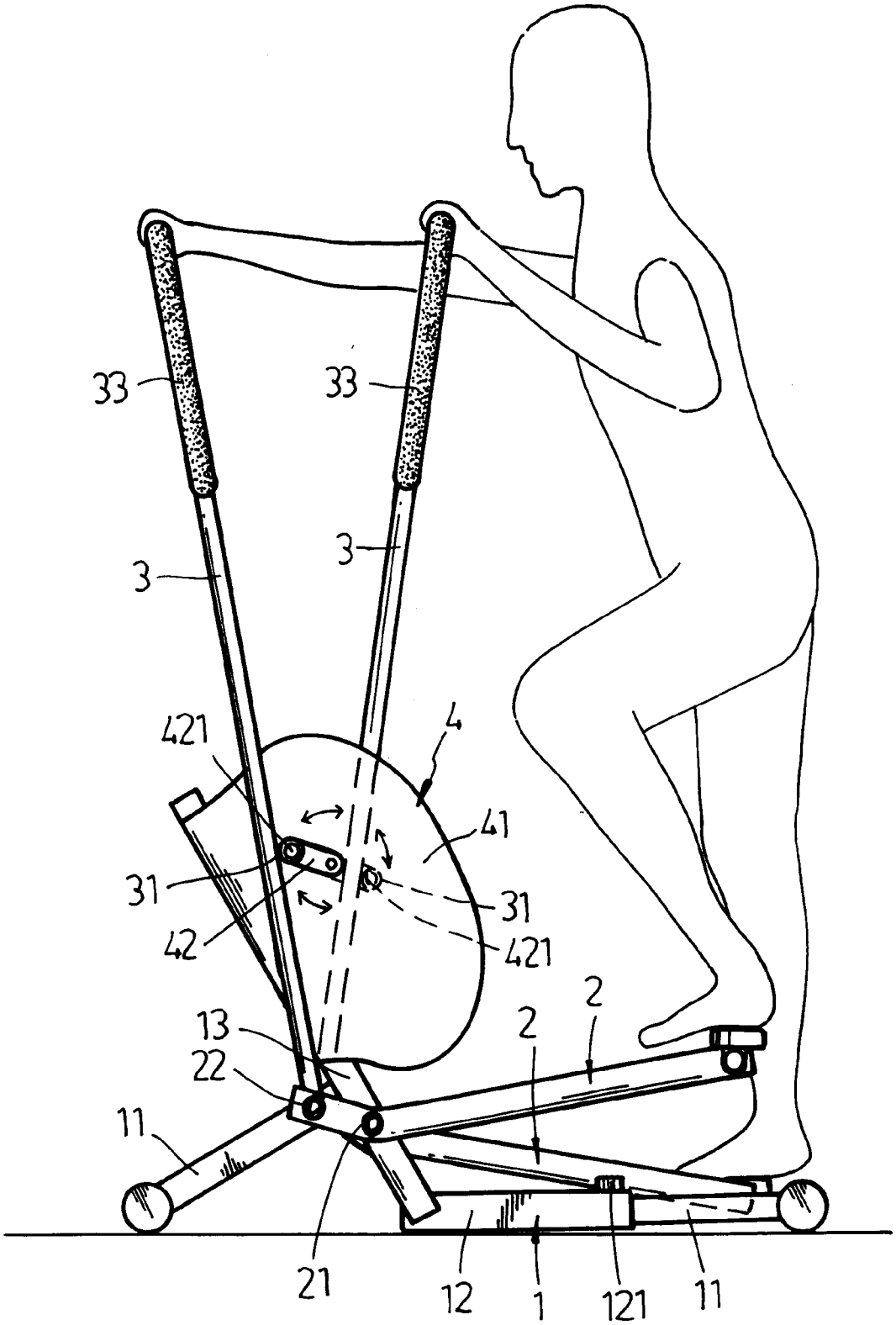
FIG. 3 is an applied view of the present invention, showing the pedals stepped up and down, the handlebars turned back and forth.

Referring to FIG. 3, when the player steps on the foot plate 23 at each of the pedals 2 up and down alternatively, the handlebars 3 are alternatively turned back and forth with the hands along a smoothly arched track, and at the same time the internal mechanism of the damping mechanism 4 is turned to impart a damping force to the handlebars 3.

While only one embodiment of the present invention has been shown and described, it will be understood that various modifications and changes could be made thereunto without departing from the spirit and scope of the invention disclosed.

What the invention claimed is:

1. A stepping exerciser comprising:

a base frame, said base frame comprising an upright support, and two horizontal pivots fixedly provided at two opposite lateral sides of said upright support;

a damping mechanism mounted on said upright support and spaced above the horizontal pivots at said upright support, said damping mechanism comprising two linked cranks disposed at two opposite lateral sides and rotated to impart a damping force;

two pedals respectively turned about the horizontal pivots at said upright support, said pedals each comprising a front end, a rear end, a pivot hole at said front end, a fixed foot plate at said rear end, and a fixed axle sleeve transversely disposed between said front end and said rear end and coupled to one pivot at said upright support; and two handlebars respectively coupled to said cranks and said pedals, said handlebars each comprising a top end terminating in a hand grip, a bottom end terminating in a horizontal pivot respectively coupled to the pivot hole at the front end of each of said pedals, and a barrel transversely disposed on the middle and respectively fixedly connected to said cranks.

* * * * *